United States Patent [19]

Romijn

[11] 4,285,237

[45] Aug. 25, 1981

[54] DEVICE FOR ACCURATE SUBAQUEOUS MEASUREMENTS

[75] Inventor: Anthony H. Romijn, Vlaardingen, Netherlands

[73] Assignee: Hollandsche Beton Groep N.V., Rijswijk, Netherlands

[21] Appl. No.: 114,012

[22] Filed: Jan. 21, 1980

[30] Foreign Application Priority Data

Jan. 29, 1979 [NL] Netherlands ..... 7900690

[51] Int. Cl.[3] ..... G01F 23/18; G01L 19/08

[52] U.S. Cl. ..... 73/300; 73/712; 73/714

[58] Field of Search ..... 73/728, 722, 753, 754, 73/300, 84, 712, 714

[56] References Cited

U.S. PATENT DOCUMENTS

| | | | |
|---|---|---|---|
| 2,580,299 | 12/1951 | Hunicke | 73/84 |
| 3,397,581 | 8/1968 | Bush | 73/719 |
| 4,182,178 | 1/1980 | Noite | 73/299 |

*Primary Examiner*—Donald O. Woodiel

*Attorney, Agent, or Firm*—Sughrue, Mion, Zinn, Macpeak and Seas

[57] ABSTRACT

The invention relates to a device for accurate subaqueous measurements of the vertical displacements of a reference point e.g. the head of a pile by using a pressure difference recorder at the reference point which measures the difference between an air filled chamber and the water pressure outside said chamber, said recorder being bridged by a tube interconnecting the two pressure regions and having a valve which in the open position interconnects the two regions said air chamber being located above the recorder while the valve has an electromagnetic operating member placed in a circuit with the recorder and a measuring device, the initial pressure in the air chamber being the atmospheric pressure at the water surface.

There may be two identical devices each having a switch in the circuit of the recorder which brakes the circuit at the end of the measuring range, the switches of the two devices operating such that when one interrupts the other makes its circuit.

3 Claims, 1 Drawing Figure

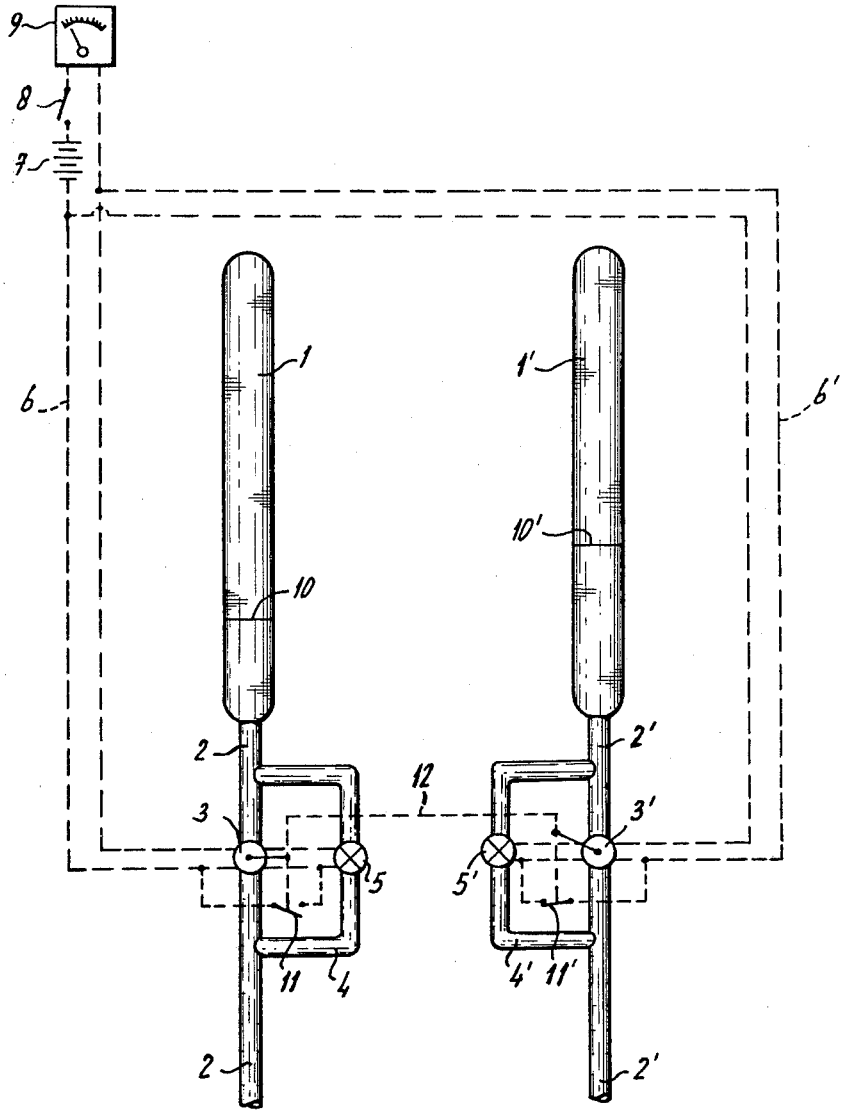
9
8
7
6
6'
1
1'
10
10'
2
2'
12
3
3'
5
5'
11
11'
4
4'
2
2'

DEVICE FOR ACCURATE SUBAQUEOUS MEASUREMENTS

This invention relates to a device for accurate measurements of the vertical displacement of a reference point under water, said device comprising a pressure-difference recorder provided at the region of the reference point, said recorder being disposed in a tube and dividing said tube in two parts, one of which being in communication with an air-filled chamber and the other part may communicate with the water pressure, said parts being connected to each other by a pipe bridging the pressure recorder, and a valve is disposed in said pipe. An apparatus of this kind is known from the published Dutch Patent Application Ser. No. 76,07190.

Said apparatus comprises a measuring device being secured in the proximity of the head of a pile and being lowered together with the pile during the pile driving, said device having a measuring range which starts at a hydrostatic pressure which lies at the beginning of the range in which the position of the pile head has to be determined, and which ends beyond said range. To that end, first of all compressed air is introduced in the air chamber via the valve embodied as a three-way cock in the bridging pipe, said compressed air having a pressure which lies in the order of the hydrostatic pressure to be expected at the region where the measuring should start. The other portion of the tube comprising the pressure-difference recorder is in communication with the outside pressure via a diaphragm or ball valve. As soon as the outside pressure in closed condition of the valve becomes higher than the pressure in the air chamber, the pressure-difference indicator willrecord said difference in pressure on a measuring device disposed above the water-level, so that the lowerings of the pile can accurately be followed.

The known apparatus has the disadvantage that the pressure in the air chamber cannot easily be adjusted accurately at the range desired where the measurement should start. In most cases, the pressure is just a little too high or too low, which will easily affect the measuring range which was deliberately limited to achieve a high degree of accuracy.

The problem is solved by the provision of a number of measuring devices, whereby the air chambers receive different pressures which, taking the measuring ranges into account, will follow each other as closely as possible. This, of course, is an expensive solution.

It is the object of this invention to provide an apparatus with which the above-mentioned difficulty is removed and which, in addition, can be used not only for subaqueous pile driving, but also for accurate depth findings in general.

In accordance with the invention, said object is achieved in that the tube portion facing away from the air chamber is open and the valve has only two positions, i.e. open and closed, whereby in the open position the open tube portion is in communication with the air chamber, said air chamber being disposed vertically above the pressure recorder and the valve comprises an electromagnetic operating element which is provided in a circuit that can be opened and closed, said circuit being also provided with the pressure recorder and a measuring device, and that the air chamber has an initial pressure which corresponds with the atmospheric pressure at the level of the water-surface. When the device according to the invention is being lowered from the level above the water-surface while the valve in the pipe bridging the pressure recorder is in the open position, water will enter the air chamber via the open communication and will compress the air available in said chamber as the measuring device is being lowered. The pressure in the air chamber is always an indicator for the depth of the measuring device. When a measurement is to be carried out, the circuit will be closed and, consequently, the communication between air chamber and outside pressure is interrupted, so that from that moment on the pressure in the air chamber remains constant. A further lowering of the device will then lead to a difference in pressure which is transmitted to the measuring device by the pressure-difference recorder. When the circuit is broken, the valve will be opened and, as a result thereof, the pressure in the air chamber will be conformed again to the hydrostatic outside pressure. By closing the circuit again, a new measuring range is obtained.

It is then possible to carry out accurate measurements for a small measuring range of e.g. 25 cm with a single device. When the measuring device is lifted again, i.e. when it is brought to a higher level with the valve in open position, the pressure in the air chamber will adapt itself automatically, so that an initial measuring point can be created at any depth desired which constitutes the zero on the scale of the reading device disposed above the water-level.

According to the invention, the circuit can comprise a switch which is connected to the pressure recorder in such a way that the circuit is broken at the end of the measuring range. In this way we have the advantage that the device with which the measurement is carried out will stop automatically when the lowering of the device has taken place and a pre-determined distance of e.g. 25 cm has been covered. It is then possible to have a highly sensitive pressure recorder at one's disposal, which has a small measuring range and which stops of its own accord each time at the end of the measuring range and which starts a new measuring range. The accuracy of the measurement will then not depend any more on the depth of operation. So we have an absolute measurement which is independent of the depth and the accuracy of which is solely a function of the relevant measuring range. For the protection of a sensitive pressure recorder with a small measuring range, said recorder should stop of its own accord and by coupling the stopping with the interruption of the circuit and, thus, with the valve, the latter will be opened and the device is adjusted for the new measuring range.

Since the changing over to a new measuring range involves a short interruption whch is needed for the requisite adjustment of the pressure, according to the invention, it is also possible, while maintaining the small measuring range and, therefore, the high accuracy of measurement, to carry out measurements continuously in that the device comprises two essentially identical devices, the switches of which controlled by the pressure recorders being connected with each other in such a way that when one switch breaks one circut, the other switch will close the other circuit and vice versa. This connection can be such that at the exact moment when one pressure recorder stops, the other will start. It is then possible to cover continuously a wide measuring range.

The invention will now be described more in detail with reference to the drawing. The FIGURE in the drawing in a schematic illustrating the principle of this invention.

In said drawing, a vertically disposed air chamber is indicated by reference numeral 1, the lower end of said chamber being in open communication with a tube 2 wherein a pressure recorder 3 is disposed. Below said pressure recorder 3 the tube 2 is in open communication with the surroundings.

The pressure recorder 3 is bridged by a pipe 4 wherein an electromagnetically controlled valve 5 is disposed. The electromagnet of valve 5 is included in a circuit 6 which is indicated by broken lines and in which also pressure recorder 3 is disposed. Circuit 6 comprises a source of current 7, as well as a switch 8 and the measuring device 9. As long as the device is above water-level and valve 5 is open, air may enter the air chamber 1 through tube 2 and 4. When the device with the valve in open condition moves towards the water-level, exactly the same pressure will prevail in the air chamber as at the level of the water-surface. As soon as the open end portion of tube 2 enters the water, the water will flow into the tube and enter the air chamber 1 via tubes 2 and 4. The water-level is indicated by reference numeral 10.

As the device is being lowered deeper, the level 10 in the chamber 1 will rise and the air pressure above the surface 10 will increase. Said pressure will then correspond with the hydrostatic pressure at the region of the inlet of tube 2.

When the valve 5 is being closed by closing switch 8, the pressure attained at that moment in the chamber 1 is fixed and further pressure gradients which occur will act only on the pressure recorder 3; said recorder may be a known piezo-electric gauge, which shows the difference in pressure on the measuring device 9. By breaking the circuit, the valve 5 is being opened and a new pressure can be adjusted in the chamber 1.

The drawing illustrates also the possibility of a double construction by using an air chamber 1', tube 2' and pressure recorder 3', as well as a by-pass pipe 4' with valve 5'.

The drawing is a diagrammatic representation of the way in which the pressure recorders 3 and 3' can operate a switch 11 and 11' in the circuit 6 and 6' respectively, when the pressure recorder reaches the end of its measuring range. Both switches are connected with each other via circuit 12 in such a way that when one switch breaks one circuit, the other switch will close the other circuit and vice versa.

This means that as soon as the pressure recorder 3 has reached the end of its measuring range and, consequently, switch 11 breaks one circuit, at the same time switch 11' will close the other circuit. Thus, as soon as valve 5 opens, valve 5' will close and the measuring process can continue; when one device is in operation, the device previously connected can adapt itself to the pressure conditions that have changed, so that the level in the chamber 1 will be changed. In chamber 1' said level is indicated by reference numeral 10'.

What we claim is:

1. Device for accurate measurements of the vertical displacement of a reference point under water, said device comprising a pressure-difference recorder provided at the region of the reference point, said recorder being disposed in a tube and dividing said tube in two parts, one of which being in communication with an air-filled chamber and the other part may communicate with the water pressure, said parts being connected to each other by a pipe bridging the pressure recorder, and a valve is disposed in said pipe, in that the tube portion facing away from the air chamber is open and the valve has only two positions, i.e. open and closed, whereby in the open position the open tube portion is in communication with the air chamber, said air chamber being disposed vertically above the pressure recorder and the valve comprises an electromagnetic operating element which is provided in a circuit that can be opened and closed, said circuit being also provided with the pressure recorder and a measuring device, and that the air chamber has an initial pressure which corresponds with the atmospheric pressure at the level of the water-surface.

2. Device according to claim 1, in that a switch is disposed in the circuit, said switch being connected to the pressure recorder in such a way that the circuit is broken at the end of the measuring range.

3. Device according to claim 2, in that the device comprises two essentially identical devices, the switches of which controlled by the pressure recorders being connected with each other in such a way that when one switch breaks one circuit, the other switch will close the other circuit and vice versa.

* * * * *